United States Patent [19]

Bross

[11] Patent Number: 4,632,472

[45] Date of Patent: Dec. 30, 1986

[54] UNDERHANGING DRAWER SYSTEM

[75] Inventor: Elly Bross, Quebec, Canada

[73] Assignee: The Stanbel Group, Montreal, Canada

[21] Appl. No.: 673,031

[22] Filed: Nov. 19, 1984

[51] Int. Cl.[4] ..... A47B 88/04

[52] U.S. Cl. ..... 312/246; 248/DIG. 9; 312/345; 312/348

[58] Field of Search ..... 312/119, 122, 126, 132, 312/345, 348, 330 R, 330 SM, 342, 245, 246; 248/188.2, 59, DIG. 9

[56] References Cited

U.S. PATENT DOCUMENTS

| | | | |
|---|---|---|---|
| 2,000,944 | 5/1935 | Gilbert et al. | 312/245 X |
| 2,111,357 | 3/1938 | Cornell, Jr. | 248/59 |
| 2,188,044 | 1/1940 | Hickman | 312/246 |
| 2,478,017 | 8/1949 | Shoemaker | 312/246 X |
| 2,657,544 | 11/1953 | Mather | 312/345 |
| 2,689,778 | 9/1954 | Chambers et al. | 312/345 X |
| 3,129,042 | 4/1964 | Liener-Kunde | 312/246 |
| 3,384,987 | 5/1968 | Prechtl | 248/DIG. 9 X |
| 3,519,319 | 7/1970 | Taylor | 312/246 |
| 3,722,975 | 3/1973 | Taylor | 312/348 |
| 3,806,220 | 4/1974 | Payne | 312/330 R |
| 3,815,800 | 6/1974 | Monahan | 312/330 R X |
| 4,105,270 | 8/1978 | Bergkamp et al. | 312/246 X |
| 4,334,715 | 6/1982 | Schreiner | 312/330 R X |
| 4,473,262 | 9/1984 | Staye | 312/330 R X |

FOREIGN PATENT DOCUMENTS

| | | | |
|---|---|---|---|
| 2258148 | 6/1973 | Fed. Rep. of Germany | 312/348 |
| 2349438 | 4/1975 | Fed. Rep. of Germany | 312/126 |
| 1473050 | 3/1967 | France | 312/245 |
| 11714 | of 1896 | United Kingdom | 312/330 R |
| 1624 | of 1913 | United Kingdom | 248/188.2 |
| 1589512 | 5/1981 | United Kingdom | 312/348 |

*Primary Examiner*—William E. Lyddane
*Assistant Examiner*—Thomas A. Rendos
*Attorney, Agent, or Firm*—Hill, Van Santen, Steadman & Simpson

[57] ABSTRACT

A slidable drawer system is provided for mounting below a stationary shelf or cupboard which does not require later support or side rails, but rather utilizes guide rails which receive flanges extending outwardly from the tops of the sidewalls. Thus, the guide rails are mounted directly to the bottom of the shelf or are spaced from the bottom surface in the case of cupboards with an underhang. A resilient finger is provided on the guide rail to engage with the rear wall of the drawer to prevent accidental disengagement of the drawer from the rails while permitting selective disengagement.

1 Claim, 8 Drawing Figures

FIG. 1
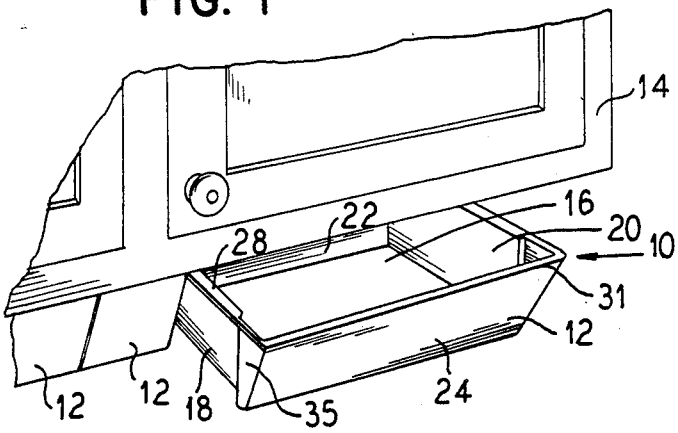
FIG. 3
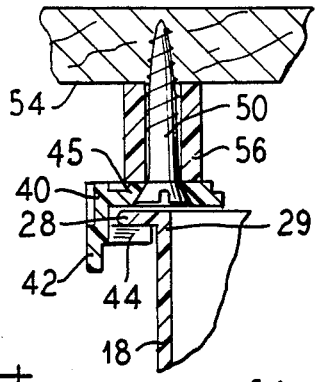
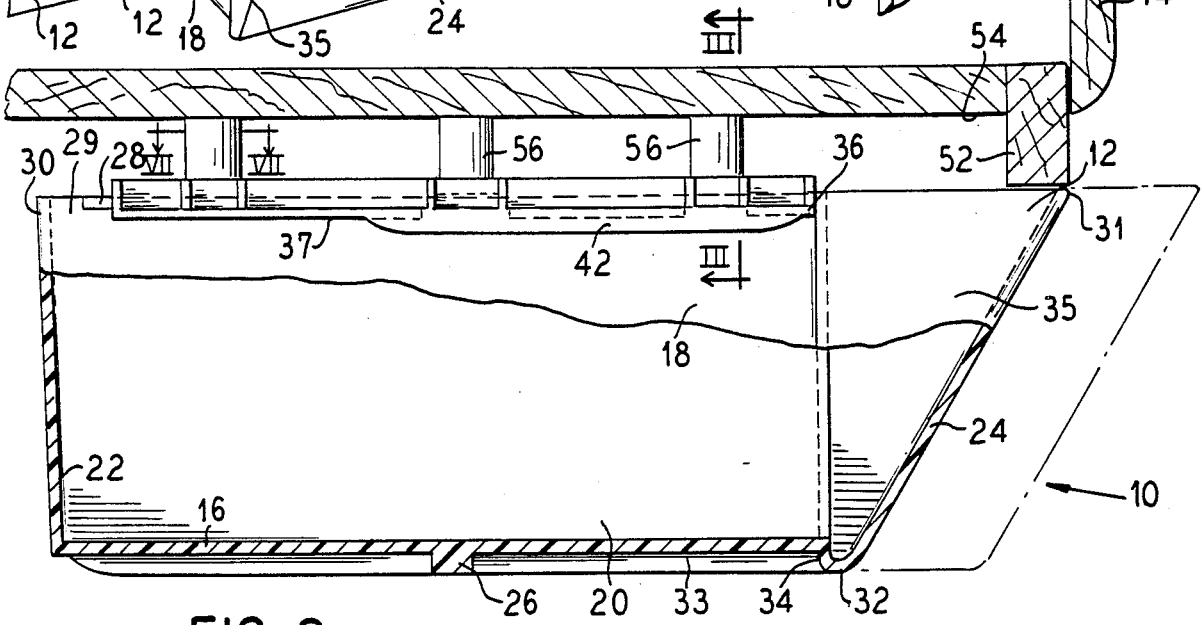
FIG. 2
FIG. 5
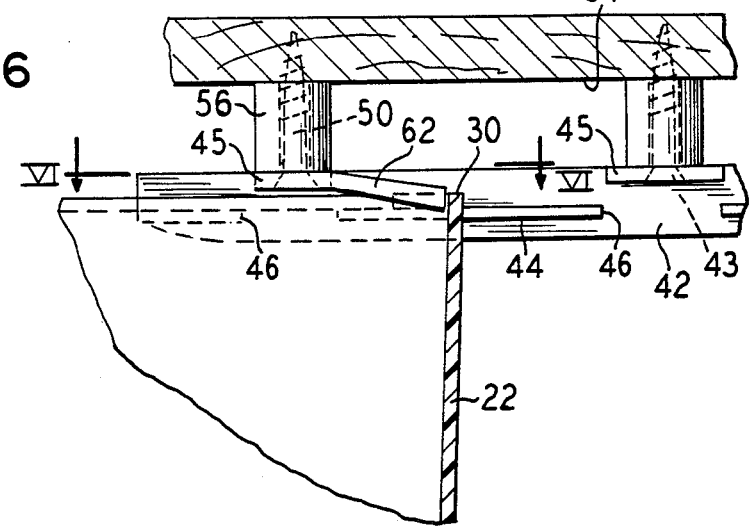
FIG. 6
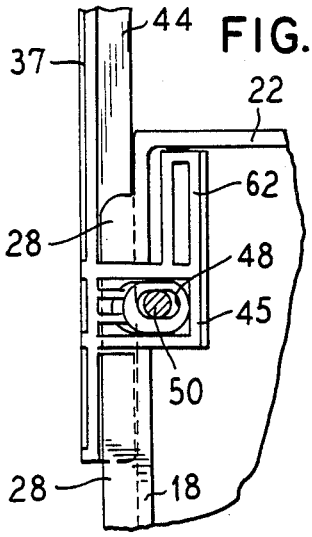

UNDERHANGING DRAWER SYSTEM

BACKGROUND OF THE INVENTION

1. Field of the Invention

The present invention relates to a drawer system and more specifically to a sliding drawer or shelf mounted on rails beneath a cabinet or fixed shelf.

2. Description of the Prior Art

In many kitchens, bathrooms and other rooms cupboards and cabinets are utilized for storing various items and generally the shelves on which the items are stored are fixed horizontally rather than being slidable with respect to the cabinet or frame of the shelf unit. Where slidable shelves or drawers are provided, generally side rails are utilized for the shelf to slide on which require that there be some lateral support for carrying the rails.

In some shelf units, the shelves are spaced quite widely and the entire area between shelves is not utilized. Also, in cabinet and shelf units which are suspended on a wall above the floor or above a counter surface, the space below the cabinet or shelf unit may not be completely utilized.

Therefore, it would be desirable to have a shelf or drawer unit which could be attached to areas of inadequate utilization to increase the storage capacity of the cupboard or shelf unit.

SUMMARY OF THE INVENTION

The present invention provides for a slidable drawer or shelf system which can be attached to the underside of a shelf or the underside of a cabinet unit, even if the cabinet unit has an underhang. The system includes a pair of rails which are to be secured to the underside of the shelf or cabinet to receive the sliding drawer or shelf member. Spacers are provided in the event that the cabinet has an underhang in order to space the rails to extend below the underhang. The drawer or shelf member has side walls with a top flanged surface to slidingly engage with the rails. The drawer or shelf unit also has a rear wall which prevents items from being pushed through the back of the drawer or shelf unit, especially while it is being slid forwardly to a more accessible position. Also, the rails are provided with a downwardly sloped projecting finger which engages with the rear wall to provide a positive stop to prevent the drawer or shelf unit from being slid completely out of the rails. The finger is resilient and can be manually displaced to allow for complete removal of the drawer or shelf unit.

Thus, the present invention provides for a storage system which can be utilized to increase the storage capacity of existing cupboards and shelf units.

BRIEF DESCRIPTION OF THE DRAWINGS

FIG. 1 is a perspective view of a drawer unit embodying the principles of the present invention suspended below a cabinet.

FIG. 2 is a side sectional view of the drawer system shown in FIG. 1.

FIG. 3 is a partial sectional view taken generally along the line III—III of FIG. 2.

FIG. 5 is a partial side sectional view showing the finger stop arrangement.

FIG. 6 is a partial sectional view taken generally along the line VI—VI of FIG. 5.

DESCRIPTION OF THE PREFERRED EMBODIMENTS

In FIG. 1 there is shown a slidable underhanging drawer system generally at 10 which includes a slidable drawer member 12 mounted beneath a cupboard 14. The mounting arrangement is shown in greater detail in FIGS. 2, 3 and 4.

Figure 4:
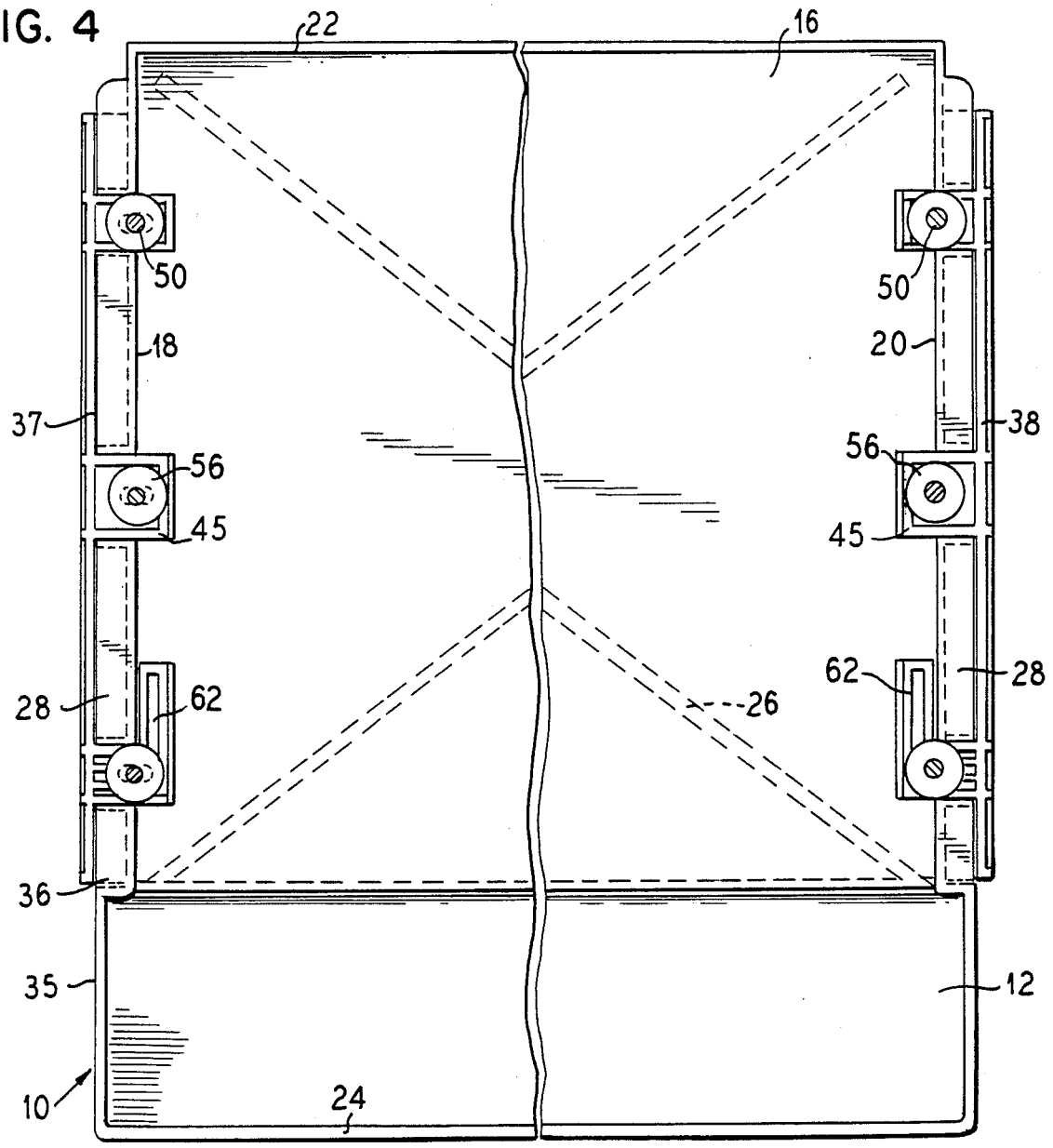
FIG. 4 is a plan view of the drawer unit of FIG. 1.

In FIGS. 2, 3 and 4 it is seen that the drawer unit 12 has a bottom wall 16, opposed side walls 18, 20 a rear wall 22 and a forwardly sloping front wall 24. The bottom wall 16 is reinforced by supporting ribs 26 to increase the rigidity and strength of the drawer unit 12. The side walls 18, 20 have an outwardly projecting flange 28 at an upper end 29 thereof. The top end 29 of the side walls as well as a top end 30 of the rear wall 22 and a top end 31 of the front wall 24 are coplaner to thus provide a flush top perimeter of the drawer unit.

The front wall 24 extends downwardly to a bottom edge 32 coplaner with the support ribs 26 and below a bottom surface 33 of the bottom wall 16. Thus, a lip 34 is formed just behind the bottom edge 32 of the front wall to assist in grasping and sliding the drawer 10 without requiring knobs or handles on the front wall. Also, the front wall 24 extends laterally beyond the side walls 18, 20 to be even with the flanges 28. A short side wall 35 leading from the front wall 24 back toward the side walls 18, 20 terminates at an end 36 of the flanges 28 providing a stop to prevent excessive rearward movement of the drawer. Besides providing a stop function, the extra width of the front wall allows two or more drawer units to be mounted closely adjacent to one another without unsightly gaps between the units as shown in FIG. 1.

A pair of rails 37, 38, being left and right-hand rails, respectively are provided to engage and hold the flanges 28 of the drawer system. As shown in FIG. 3, the rail 37 has a vertical support portion 40 including a supporting rib 42 along a bottom edge of the rail and a horizontally projecting ledge 44 on which the flange 28 slides. A plurality of horizontal mounting pads 45 project inwardly above the ledges 44 and are spaced above gaps 46 in the ledges. The mounting pads each have apertures 48 therethrough to receive fastening means such as screws 50. The aperture 48 is formed such that the fastening member 50 can be countersunk into the pad 45 such that the fastening member 50 will not project into the space between the pad 45 and the ledge 44. Thus, the flange 28 of the drawer unit 12 is free to slide on the ledge 44 without restriction up to the stop formed by the extending side wall 35.

As shown in FIG. 2, the cupboard 14 has an underhang 52 which is a front trim board extending downwardly below a bottom surface 54 of the cupboard 14. In order to permit the drawer unit 12 to slide forwardly beyond the front of the cupboard, the rails 37, 38 must be spaced below the bottom surface 54 of the cupboard 14. To provide this spacing there are a plurality of spacers 56, each to be used in conjunction with the fastening members 50. The spacers are provided in the form of a tube which can be cut to size to meet the particular needs by the installer of the drawer unit.

Figure 7:
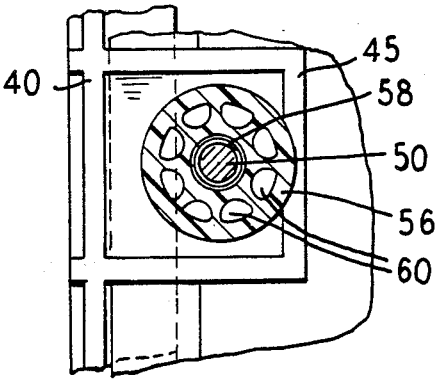
FIG. 7 is a partial sectional view taken generally along the line VII—VII of FIG. 2.

It is important that the spacers 56 remain rigid when the fastening member 50 compresses the spacer 56 when it is fully inserted. As shown in FIG. 7, the cross-sectional view of the spacer 56 shows that the spacer is a cylindrical tube with a central passage 58 therethrough for receiving the fastener 50. The annular wall of the spacer is relatively thick compared to the passage 58. Within the wall there are a plurality of smaller passages 60 which permit the usage of a lesser amount of material for the spacer without interferring with the strength and rigidity of the spacer itself.

FIG. 5 is a side sectional view from the interior of the drawer unit 12 showing the operation of a safety stop mechanism. Projecting downwardly and rearwardly from the front mounting pad 45 is a resilient finger 62 which is engagable with the rear wall 22 of the drawer unit 12. Thus, as the drawer unit 12 is slid forwardly, the fingers 62 engage the rear wall 22 preventing complete forward movement of the drawer unit 12 thus preventing accidental disengagement of the shelf from the rails. The fingers 62 are resilient and can be pushed upwardly to disengage the rear wall when it is specifically desired to completely remove the drawer unit 12 from the rails.

Also as seen in FIG. 6, the aperture 48 for receiving the fastening members 50 in the left hand rail 37 is formed in an oval extending transversely of the length of the rail to permit slight lateral adjustment of the rail after it has been loosely secured to the cabinet 14 and prior to complete and secure attachment.

Figure 8:
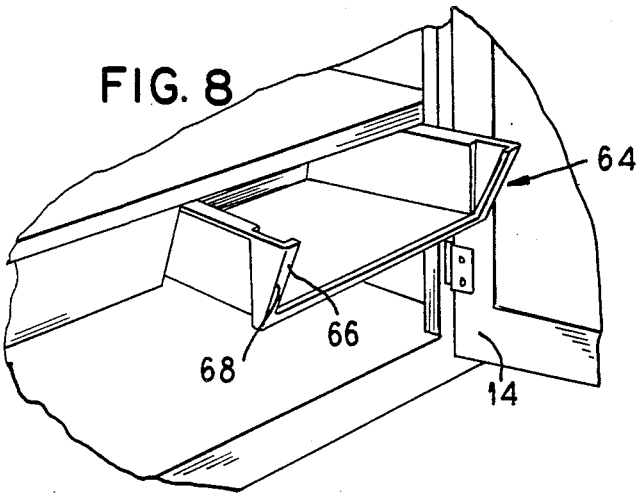
FIG. 8 is a perspective view of a shelf system suspended beneath a fixed shelf.

Shown in FIG. 8 is a slidable shelf unit 64 which differs from the slidable drawer unit 12 only in the configuration of the front wall. The slidable drawer unit 12 has a solid front wall 24 extending the entire width and height of the drawer unit. The shelf unit 64 has a large opening 66 at its front end resulting in only a thin border lip 68 extending across the width of the bottom of the shelf and up the two sides. Thus, the shelf unit 64 permits access to the shelf without sliding the shelf forwardly, and provides increased access to the shelf when the drawer is slid forward. In all other respects, the shelf unit 64 operates identically to the drawer unit 12.

The shelf and drawer units can be fabricated in any desirable width in that the rails are each attached separately and are therefore not affected by the width of the drawer or shelf units. Also, a plurality of drawer or shelf unit systems can be positioned laterally adjacent one another to provide a series of separate storage areas.

As is apparent from the foregoing specification, the invention is susceptible of being embodied with various alterations and modifications which may differ particularly from those that have been described in the preceeding specification and description. It should be understood that I wish to embody within the scope of the patent warranted hereon all such modifications as reasonably and properly come within the scope of my contribution to the art.

I claim as my invention:

1. A slidable drawer system mounted beneath a stationary shelf comprising:

a drawer member having a bottom wall and a perimeter of upstanding sidewalls, a rear wall and a front wall;

said side walls having an outwardly projecting flange at a top end thereof;

said front wall extending the entire width and height of said drawer member to provide a closed front end to said drawer member;

said front wall extending downwardly below a bottom surface of said bottom wall to form a lip along a bottom edge of said front wall to assist manual grasping of said drawer member;

a pair of guide rails, each rail mounted to a bottom side of said shelf to slidingly receive said flange of one of said sidewalls;

said guide rails having a plurality of horizontal mounting pads, horizontal ledges on which said flanges slide, and a vertical support portion between said mounting pads and said ledges;

said mounting pads projecting horizontally inwardly from said vertical support portion above said ledges also projecting horizontally inwardly, said ledges having gaps therein below said pads to provide access for said pads;

said shelf having an underhang and said system further including a plurality of spacer members each formed as a tube for use with said fasteners to space said rails below said shelf underhang and cut to size to permit said drawer member to clear said underhang as it is slid forwardly on said rails;

at least one of said guide rails having a downwardly and rearwardly projecting resilient finger formed integrally therewith near a front end of said rail which is engagable with said rear wall to prevent said drawer member from being completely slid forwardly on said rails to a point of disengagememt between said rails and said flanges, but which can be deflected to disengage from said rear wall to permit selected disengagement between said rails and said flanges;

fastening means comprising threaded fasteners to secure said guide rails to said bottom side of said shelf;

said gide rails having aperatures in said mounting pads receiving said fasteners, said apertures in at least one of said rails being formed as lateral slots to permit slight lateral adjustment of said rails as they are being secured to said bottom side of said shelf;

said front wall extending laterally beyond said side walls to be approximately even with said flanges and including two short side walls leading from the lateral edges of said front wall rearwardly to a pair of short transverse walls to join with said side walls, said transverse walls forming a stop engageable with a front end of said guide rails to prevent excessive rearward movement of said drawer;

whereby, said drawer member can be slid on said rails between a forward accessible position and a rearward concealed position.

* * * * *